US005123393A

United States Patent [19]

Djordjevic

[11] Patent Number: 5,123,393

[45] Date of Patent: Jun. 23, 1992

[54] TIMING CONTROL SYSTEM FOR FUEL INJECTION PUMP

[75] Inventor: Ilija Djordjevic, East Granby, Conn.

[73] Assignee: Stanadyne Automotive Corp., Windsor, Conn.

[21] Appl. No.: 754,577

[22] Filed: Sep. 4, 1991

[51] Int. Cl.[5] ..... F02M 39/00

[52] U.S. Cl. ..... 123/502; 123/450; 417/462

[58] Field of Search ..... 123/502, 450, 449, 462; 417/462

[56] References Cited

U.S. PATENT DOCUMENTS

| | | | |
|---|---|---|---|
| 3,394,688 | 7/1968 | Roosa . | |
| 3,433,159 | 3/1969 | Kemp | 123/450 |
| 3,439,624 | 4/1969 | Glikin | 123/450 |
| 3,447,520 | 6/1969 | Drori | 123/450 |
| 3,552,366 | 11/1971 | Kemp . | |
| 4,037,573 | 7/1977 | Swift . | |
| 4,050,432 | 9/1977 | Davis et al. . | |
| 4,050,433 | 9/1977 | Tokashiki | 123/502 |
| 4,074,667 | 2/1978 | Skinner | 417/462 |
| 4,079,719 | 3/1978 | Varcoe . | |
| 4,080,109 | 3/1978 | Green | 123/502 |
| 4,116,186 | 9/1978 | Drori | 417/462 |
| 4,125,104 | 11/1978 | Stein | 417/462 |
| 4,138,981 | 2/1979 | Green | 417/462 |
| 4,432,327 | 2/1984 | Salzgeber . | |
| 4,453,522 | 6/1984 | Salzgeber . | |

FOREIGN PATENT DOCUMENTS

| | | | |
|---|---|---|---|
| 817680 | 8/1959 | United Kingdom | 123/450 |

*Primary Examiner*—Carl Stuart Miller

*Attorney, Agent, or Firm*—Chilton, Alix & Van Kirk

[57] ABSTRACT

A rotary distributor fuel injection pump having a timing piston for controlling the fuel injection timing in accordance with opposed fuel pressures in advance and back pressure chambers at opposite ends of the piston, a restricted passage for supplying fuel at a restricted rate to the back pressure chamber, a pressure relief valve for limiting the back pressure, a dump valve for dumping the back pressure to advance the timing for starting and a rotary inlet metering valve having a bleed port connected to the back pressure chamber and a helical metering edge which cooperates with the bleed port to control the bleed rate and therefore the timing in relation to engine load to provide a light load advance or light load retard.

14 Claims, 2 Drawing Sheets

TIMING CONTROL SYSTEM FOR FUEL INJECTION PUMP

SUMMARY OF THE INVENTION

The present invention relates generally to fuel injection pumps of the type having an inlet metering valve for regulating the fuel injection quantity and a hydraulically positioned timing piston for controlling the fuel injection timing. The present invention relates more particularly to a new and improved timing control system for hydraulically positioning the timing control piston in accordance with both the injected fuel quantity and engine speed.

In fuel injection pumps of the type described, it is often desirable to vary the fuel injection timing with the injected fuel quantity, as well as with engine speed, to increase engine efficiency, reduce engine noise, reduce emissions or otherwise improve engine operation. For example, in some applications, it has been found desirable to advance fuel injection timing at light load and in other applications, it has been found desirable to retard fuel injection timing at light load.

In fuel injection pumps of the type described, a cam ring is normally employed for actuating one or more pumping plungers to periodically deliver high pressure charges of fuel for fuel injection. In such pumps, the fuel injection timing is often regulated by adjusting the relative angular position of the cam ring and the pumping plungers, for example as shown in Varco et al U.S. Pat. No. 4,079,719, dated Mar. 21, 1978 and entitled "Timing Control for Fuel Pump".

It is a primary aim of the present invention to provide in a fuel injection pump of the type described, a new and improved timing control system which automatically adjusts the fuel injection timing at light load. Depending on the application, the timing control system is configured to advance or retard the fuel injection timing at light load.

It is another aim of the present invention to provide in a fuel injection pump of the type described, a new and improved timing control system which provides a timing adjustment of the pump at light load of up to 5°.

It is another aim of the present invention to provide in a fuel injection pump of the type described, a new and improved timing control system which automatically adjusts the fuel injection timing in conjunction with changes in both the injected fuel quantity and engine speed.

It is a further aim of the present invention to provide a new and improved timing control system having one or more of the foregoing advantages and which may be readily and economically incorporated in conventional fuel injection pumps of the type described.

Other objects will be in part obvious and in part pointed out more in detail hereinafter.

A better understanding of the invention will be obtained from the following description and accompanying drawings of an illustrative application of the present invention.

DESCRIPTION OF PREFERRED EMBODIMENT

Figure 1:
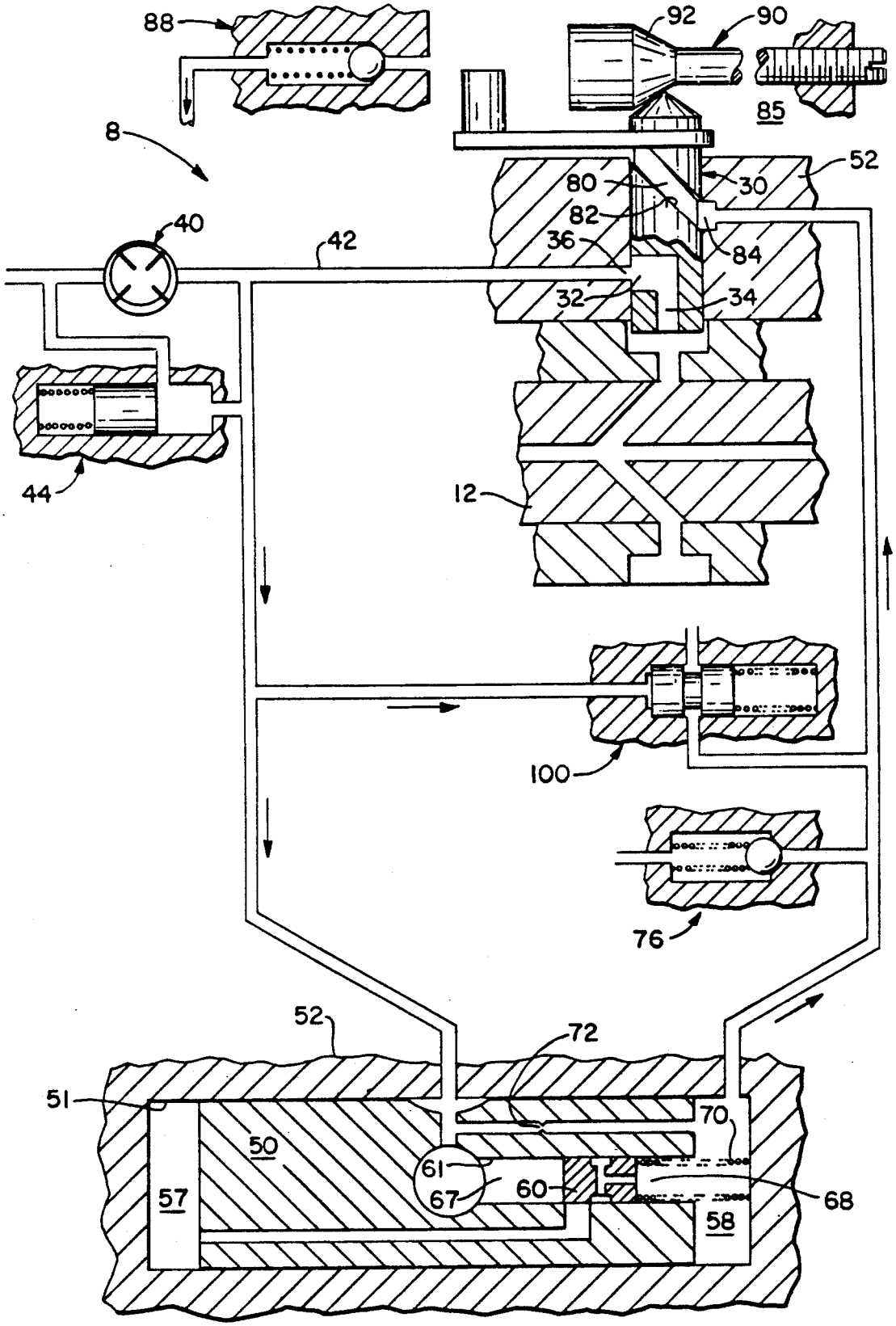
FIG. 1 is a partial diagrammatic view, partly broken away and partly in section, of a fuel injection pump incorporating an embodiment of the present invention.

In the drawings, the same numerals are used to identify the same or like functioning parts. The present invention has notable utility in a rotary distributor fuel injection pump 8 of the type having a suitable all speed governor (no shown). Except as otherwise described herein, the pump 8 may operate and be constructed like the pump disclosed in U.S. Pat. No. 4,079,719. Therefore, U.S. Pat. No. 4,079,719, which is incorporated herein by reference, should be referred to for any details not disclosed herein.

The exemplary pump 8 is designed for use with a four cylinder engine. In a conventional manner, the pump 8 has a reciprocating, positive displacement charge pump 10. A rotor 12 of the charge pump 10 forms part of a pump drive shaft which is driven by the associated engine at one-half engine speed. The charge pump 10 has two opposed pumping plungers 14 mounted for reciprocation within a diametral bore 16 for pumping fuel from a central pumping chamber 18 formed between the plungers 14. A cam ring 20 encircling the rotor 12 has an internal cam 22 with four equiangularly spaced cam lobes 24 engageable by plunger actuating rollers 26 for periodically camming the plungers 14 inwardly together during rotation of the rotor 12. The cam ring 20 is angularly adjustable to vary the charge pump stroke timing and thereby vary the fuel injection timing.

A metering valve having a rotary valve member 30 meters fuel to the pumping chamber 18 during the outward intake strokes of the pumping plungers 14. The valve member 30 is connected to be operated by an all speed governor to govern the engine speed. The valve member 30 has a circular inlet port 32 and an internal passage 34, formed by radial and axial bores, connecting the inlet port 32 to the inner axial end of the metering valve 30. The inlet port 32 cooperates with a fuel supply port 36 in the pump housing to meter fuel to the charge pump 10 in a conventional manner. The inlet port 32 serves to meter or regulate the fuel flow from the supply port 36 to the charge pump 10 during each intake stroke in relation to the angular position of the valve member 30. Typically, the valve member 30 is angularly adjustable (e.g., through an angle of 40°) between a closed or idle limit position shown in FIG. 3 at which the supply port 36 is fully or nearly fully covered by the valve member 30 and an open limit position (not shown) at which the supply port 36 is fully uncovered by the inlet port 32.

Fuel under pressure is supplied by a transfer pump 40 to the supply port 36 via a pump outlet line 42. The transfer pump 40 is a vane type pump mounted on and driven by the pump rotor 12. In a conventional manner, a pressure regulator 44 is connected to the pump outlet line 42 to regulate the transfer pressure so that it increases with pump speed. For example, the transfer pressure is regulated to increase from 40 psi at engine idle to 150 psi at maximum engine RPM.

Figure 2:
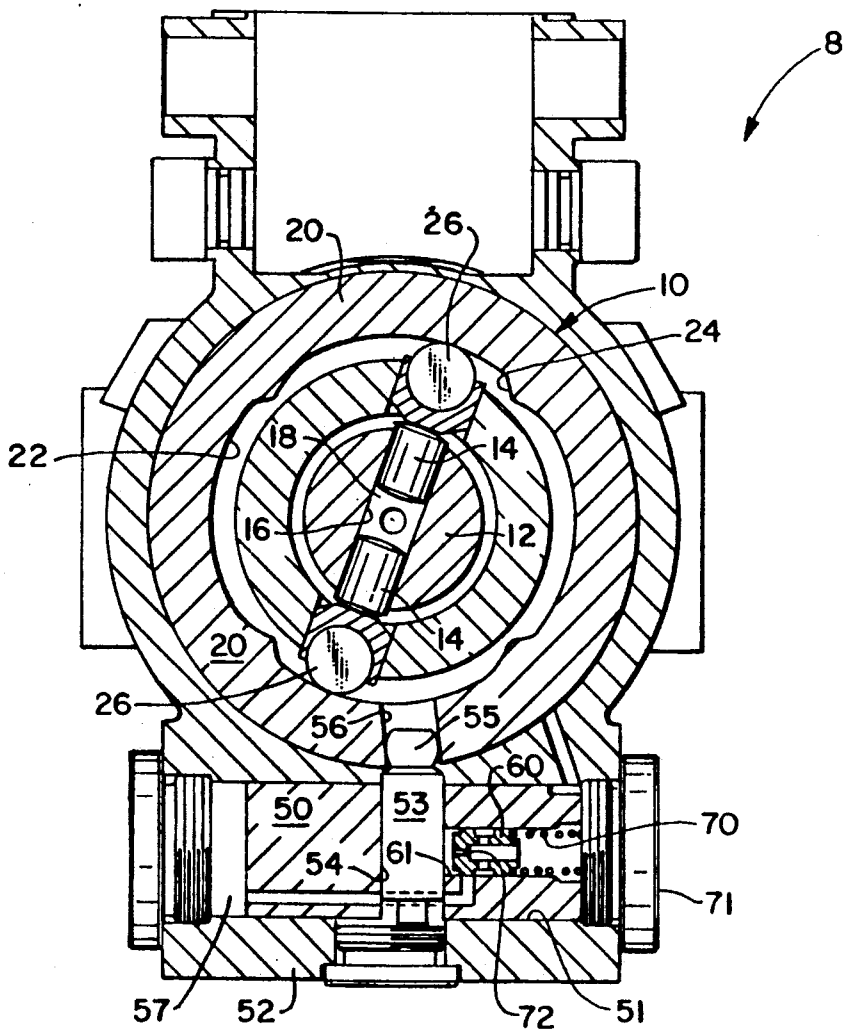
FIG. 2 is a transverse section view, partly broken away and partly in section, of a slightly modified embodiment of the fuel injection pump.

A linear working piston 50 is mounted within a transverse cylinder 51 in the pump housing 52. A pin 53, mounted within a diametral bore 54 in the piston 50, has a partly spherical head 55 received within a radial bore 56 in the cam ring 20 for mechanically connecting the working piston 50 to the cam ring 20. Therefore, the axial or linear position of the working piston 50 determines the angular position of the cam ring 20. Thus, the working piston 50 serves as a timing control piston for establishing the fuel injection timing. A pair of operating chambers 57, 58, separated by the working piston 50, are provided at the opposite ends of the piston cylinder 51. One end chamber 58 serves as a back pressure chamber and the other chamber 57 serves as an advance chamber. Fuel is metered to the advance chamber 57 to shift the timing piston 50 in an advance direction, to the right as shown in FIGS. 1 and 2. Fuel is metered from the end chamber 57 to the back pressure chamber 58 to shift the timing piston 50 in the opposite or retard direction.

A linear pilot or servo valve member 60 is mounted within a coaxial bore 61 in the back end of the working piston 50. A pair of servo valve operating chambers 67, 68, separated by the servo valve member 60, are provided at the opposite ends of the servo valve bore 61. The outer end chamber 68 opens into the back pressure chamber 58 and serves as a back pressure chamber for the servo valve member 60. The transfer pump outlet line 42 is connected to supply fuel at transfer pressure to the inner end or advance chamber 67 to urge the servo valve member 60 in an advance direction, to the right as shown in FIGS. 1 and 2. The servo valve member 60 is biased in the retard direction by the back pressure in the back pressure chamber 68 and by a coil compression spring 70 mounted between the servo valve member 60 and a threaded plug 71 mounted in the housing 52 at the back end of the cylinder 51. The force of the compression spring 70 increases as the servo valve member 60 is shifted, in the advance direction, to the right as shown in FIGS. 1 and 2.

In a conventional manner, the servo valve member 60 sets the axial position of the working piston 50 and therefore also serves as a timing control piston for establishing the fuel injection timing. Specifically, the servo valve member 60 selectively meters fuel from the inner end chamber 67 to the advance chamber 57 and selectively meters fuel from the advance chamber 57 to the back pressure chamber 68. Thus, the working piston 50 is hydraulically controlled and actuated to follow the axial movement of the servo valve member 60.

As indicated, fuel from the advance chamber 57 is selectively metered to the back pressure chamber 58 by the servo valve member 60. In addition, the back pressure chamber 58 is connected via a suitable orifice or restriction 72 to a fuel source at transfer pressure. The connection may be made directly to the inner end chamber 67 by an axial orifice 72 in the servo valve member 60 as shown in FIG. 2 or by an offset, axial orifice 72 in the working piston 50 as shown in FIG. 1 (or the orifice connection may be made by an external passageway (not shown) connected to the back pressure chamber 58).

A suitable pressure relief valve 76 is connected to the back pressure chamber 58 to limit the back pressure to a predetermined maximum which is less than the servo advance chamber pressure (in advance chamber 67) at a predetermined speed (at idle speed in the described embodiment). For example, if the transfer pressure is 40 psi at idle, the pressure relief valve 76 limits the back pressure to 35 psi. This ensures that, throughout the full range of engine operation, the transfer pressure in the servo advance chamber 67 exceeds the back pressure in the chambers 58, 68.

Figure 4:
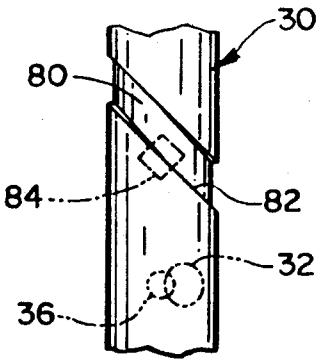
FIGS. 3–5 are enlarged, generally diagrammatic views, partly broken away, showing a rotary metering valve of the fuel injection pump in full lines and fixed and rotatable metering ports of the valve in broken lines.
Figure 3:
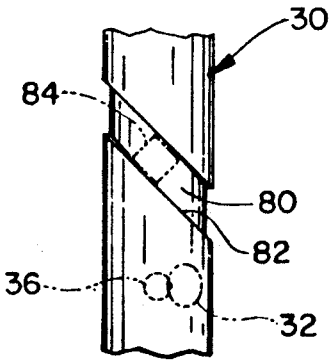
Figure 5:
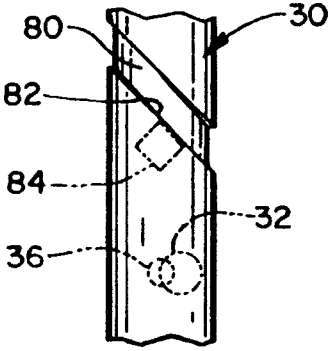

The metering valve member 30 has a peripheral, generally helical slot or port 80 at its upper end which forms a straight, generally helical, bleed metering edge 82. The slot 80 cooperates with a bleed port 84 in the pump housing 52 connected to the back pressure chamber 58. Fuel is bled from the back chamber 58 via the bleed port 84 and slot 80 to the outer axial end of the metering valve member 30 (i.e., to an upper governor chamber 85 in the pump housing 52). The bleed metering edge 82 restricts or regulates the bleed rate in relation to the angular position of the metering valve member 30 and therefore engine load. The helical metering edge 82 has a helix angle within a range of 40° to 45°. The bleed port 84 is preferably square shaped as shown in FIGS. 3–5 with its leading and trailing edges parallel to the straight metering edge 82. The bleed rate is thereby made more directly proportional to the angular adjustment of the metering valve 30.

To provide a light load advance, the bleed port 84 is partly or fully uncovered by the slot 80 as shown in FIG. 3 when the metering valve member 30 is at its closed or minimum load limit position. The bleed port 84 is increasingly closed by the bleed metering edge 82 as the metering valve 30 is opened. For example, as shown in FIG. 5, the bleed port 84 is fully closed after the metering valve member 30 is opened 20° or approximately one-half of its available travel. At light load, for example with the metering valve within 16° of its fully closed position, the back pressure in chambers 58, 68 is fully dumped to provide a minimum back pressure equal to housing pressure (which is maintained for example at 10 psi by a suitable pressure relief valve 88 which is shown connected to the governor chamber 85 for illustration). When the back pressure is dumped, the pressure differential across the servo valve 60 is increased by a large factor. For example, when the back pressure is dumped at idle RPM, the pressure differential across the servo valve 60 is increased from 5 psi to 30 psi. An advance of up to 10° of engine crankshaft rotation (5° of rotation of pump rotor 12) can then be provided by employing a back spring 70 having an appropriate, relatively low, spring rate.

The light load timing control may be configured to provide a light load retard rather than the described light load advance. In that alternative, the bleed port 84 is fully closed at the closed or minimum load limit position of the valve member 30. The bleed port 84 is opened as the valve member 30 is rotated to increase the load and the bleed port 84 is fully opened, for example, after the valve member 30 is rotated 20° or approximately one-half of the available adjustment. Depending on the width of the bleed slot 80, the bleed port 84 then remains open or is partly or fully closed as the valve member 30 is rotated beyond that intermediate position to its fully open position.

The metering valve 30 is axially adjustable to adjust the bleed port restriction at the closed or minimum load limit position of the valve member 30. In that way, the maximum light load advance or retard is adjusted. A threaded adjustment pin 90 has a tapered or conical section 92 which establishes the axial position of the valve member 30. The inlet fuel pressure at the inner end of the metering valve 30 biases the metering valve 30 upwardly into engagement with the conical section 92. The pin 90 is manually adjusted to axially adjust the valve member 30 as desired.

A transfer pressure operated, dump valve 100 is connected to the back pressure chamber 58. This dump valve 100 has a linear valve member which is biased to its open position shown in FIG. 1 by a suitable compression spring to dump the back pressure in chamber 58 during starting (while the transfer pressure is below 40 psi for example) and thereby ensure that the fuel injection timing is fully advanced during starting. The transfer pressure shifts the dump valve member, to the right as seen in FIG. 1 to hold the dump valve 100 at and above idle RPM.

As will be apparent to persons skilled in the art, various modifications, adaptations and variations of the foregoing specific disclosure can be made without departing from the teachings of the present invention.

I claim:

1. In a fuel injection pump for an internal combustion engine having reciprocating pumping means, operating cam means for periodically actuating the pumping means to provide periodic intake and pumping strokes thereof to respectively receive an intake charge of fuel and deliver fuel at high pressure for fuel injection, a fuel supply pump for supplying a source of fuel at a supply pressure which increases with pump speed, a metering valve having a supply port connected to said source of fuel, a rotary valve member having inlet metering means cooperating with the supply port for metering fuel to the pumping means during the intake strokes thereof, the rotary valve member being angularly adjustable between idle and open angular positions thereof to vary the rate of fuel metered to the pumping means and thereby regulate the intake charge of fuel, timing control means comprising a piston bore, a timing control piston reciprocally mounted within the bore to form separate advance and back pressure hydraulic chambers at opposite ends of the control piston to hydraulically shift the control piston in opposite advance and retard directions thereof respectively, the control piston being connected to advance and retard the pumping means respectively by shifting the control piston in its said advance and retard directions respectively, spring means biasing the control piston in its retard direction with a force which increases as the control piston is shifted in its said advance direction, fuel conducting means conducting fuel from said source of fuel to the advance chamber to hydraulically bias the control piston in the advance direction with a force which increases with pump speed and conducting fuel from said source of fuel to the back pressure chamber at a restricted rate, a pressure relief valve connected to the back pressure chamber for limiting the back pressure to a value less than the advance chamber pressure, the metering valve having a bleed port connected to the back pressure chamber for bleeding fuel from the back pressure chamber to reduce the back pressure therein, and the rotary valve member having bleed metering means cooperating with the bleed port to vary the bleed port opening and thereby vary the rate of fuel bled from the back pressure chamber during a predetermined range of rotation of the valve member.

2. A fuel injection pump according to claim 1 wherein the bleed metering means cooperates with the bleed port to increase the bleed port opening as the rotary valve member is rotated, within said predetermined range of rotation of the valve member, towards its idle position.

3. A fuel injection pump according to claim 1 wherein said bleed port opening is at a maximum at approximately the idle position of the rotary valve member.

4. A fuel injection pump according to claim 1 wherein said predetermined range of rotation of the valve member extends between said idle position and an intermediate position between said idle and open positions.

5. A fuel injection pump according to claim 1 wherein the the rotary valve member provides an inlet passage, controlled by the inlet metering means, between the supply port and one axial end of the valve member and a separate bleed passage, controlled by the bleed metering means, between the bleed port and the opposite axial end of the valve member.

6. A fuel injection pump according to claim 1 wherein the bleed metering means comprises a generally helically extending bleed metering edge and wherein the pump further comprises means for axially adjusting the rotary valve member to adjust the position of the bleed metering edge relative to the bleed port.

7. A fuel injection pump according to claim 1 wherein the bleed metering means comprises a generally straight bleed metering edge and wherein the bleed port has a generally straight edge approximately parallel to the generally straight bleed metering edge.

8. A fuel injection pump according to claim 7 wherein the bleed port has a generally rectangular shape.

9. A fuel injection pump according to claim 1 further comprising a dump valve connected to the back pressure chamber to selectively dump the back pressure therein.

10. A fuel injection pump according to claim 9 wherein the dump valve comprises a dump valve member, spring means biasing the dump valve member in one direction to an open position thereof to dump the back pressure and means connecting said source of fuel to hydraulically bias the dump valve member in the opposite direction to automatically close the dump valve member when the supply pressure reaches a predetermined level.

11. A fuel injection pump according to claim 1 wherein the pressure relief valve limits the back pressure to a predetermined maximum value less than the advance chamber pressure at approximately idle speed.

12. A fuel injection pump according to claim 1 wherein the spring means is compression spring means.

13. A fuel injection pump according to claim 1 wherein the timing control piston is a servo valve piston.

14. A fuel injection pump according to claim 1 wherein the fuel conducting means comprises a restricted axial bore in the piston for conducting fuel at a restricted rate from the advance chamber to the back pressure chamber.

* * * * *